US005701791A

United States Patent [19]

Schulze et al.

[11] Patent Number: 5,701,791

[45] Date of Patent: Dec. 30, 1997

[54] WORKPIECE PROCESSING MACHINE WITH RETRACTABLE CLAMPING DEVICE

[75] Inventors: Eckehart Schulze, Weissach; Peter Bytow, Simmozheim, both of Germany

[73] Assignee: Trumpf GmbH & Co., Germany

[21] Appl. No.: 531,777

[22] Filed: Sep. 21, 1995

[30] Foreign Application Priority Data

Sep. 24, 1994 [DE] Germany ..... 94 15 514 U

[51] Int. Cl.[6] ..... B26D 7/02

[52] U.S. Cl. ..... 83/277; 83/412; 83/460; 83/461; 269/32; 269/152; 269/234

[58] Field of Search ..... 269/32, 152, 234, 269/238; 83/36, 277, 412, 460, 461

[56] References Cited

U.S. PATENT DOCUMENTS

| | | | |
|---|---|---|---|
| 3,174,747 | 3/1965 | Friedland et al. | 269/315 |
| 3,626,790 | 12/1971 | Pinat | 83/277 |
| 3,758,099 | 9/1973 | Scott | 269/234 X |
| 4,297,927 | 11/1981 | Kuroda | 83/36 |
| 4,519,284 | 5/1985 | Hunter et al. | 269/32 X |
| 4,523,749 | 6/1985 | Kindgren et al. | 269/32 |
| 4,589,317 | 5/1986 | Kawano | 83/62 X |

FOREIGN PATENT DOCUMENTS

| | | |
|---|---|---|
| 534049 | 11/1994 | European Pat. Off. . |
| 111729 | 6/1985 | Japan . |

*Primary Examiner*—Eugenia Jones
*Attorney, Agent, or Firm*—Pepe & Hazard

[57] ABSTRACT

A workpiece being processed on a machine tool is moved by control devices to the tool head or work station of the machine mechanically or automatically. A stop defines an area around the work station from which the holding devices must be kept to prevent damage. As soon as a holding device reaches the limit of the danger zone around the tool head, it is switched into a setting releasing the workpiece and moves into a position away from the work station. The machine has a switching element connected to each holding device to be so movable, and the switching element has a switching slide which is acted on by an applied force and is supported in a first position until it abuts the stop when one slide position connects the energy source to the drive of the holding device to move it away from the stop. In another slide position, the connection to the energy source is broken and the holding device returns to the workpiece holding position.

19 Claims, 5 Drawing Sheets

WORKPIECE PROCESSING MACHINE WITH RETRACTABLE CLAMPING DEVICE

BACKGROUND OF THE INVENTION

The invention concerns machine tools, and particularly punching machines with a tool head and a workpiece guidance assembly which can move in relation to the tool head and on which there are at least two holding devices for releasably clamping the workpiece to effect its movement.

Such machine tools have computer or numeric controls for the guidance assembly. In the present invention, the holding devices can move relative to the workpiece and the guide member upon which they are supported by means of a drive device which is connected to an energy source. Drive devices for the holding devices are connected to the energy source by at least one movable switching element which is coupled to the workpiece and a stationary stop cooperates with a switching element opposite the tool head, and the holding device is controlled to move it into a position releasing the workpiece by a switching element that abuts the stop and then is moved relative to the workpiece into a position at a safe distance from the tool head.

On a machine tool of this type, the workpiece to be processed is delivered to the tool head manually or automatically. Here, the holding devices are used to hold the workpiece in a predetermined position both during movement and during the processing cycle. At the same time, the whole workpiece must be accessible to the tool head in order to avoid loss of material. This is especially true of the workpiece area covered by the holding devices which engage the workpiece.

This produces a need to effect controlled operation of the individual holding devices to move them into a position releasing the workpiece and to move them relative to the workpiece in order to make processing possible in the workpiece area otherwise covered by the holding device. At least one of the holding devices on the machine tool must always be attached to the workpiece so that the workpiece can also be moved when another holding device is released and can be held in a certain processing position.

By means of the stationary stop opposite the tool head, the so-called dead-zone stop, an area is defined on the machine tool around the tool head, from which the holding devices must be excluded to avoid damage. The movement of the holding devices guided into the released position relative to the workpiece described above must be triggered accordingly as soon as the holding device in question reaches the border of the danger area around the tool head during the movement when the workpiece is moved thereunder.

On one known machine tool, there is an electric switch connected to the workpiece guide for this purpose; when the dead-zone stop is approached, it switches on an electrohydraulic valve by which a drive for the particular holding device is activated and this may be a hydraulic piston-cylinder unit. By means of the hydraulic drive, the holding device moves to a spaced or remote position away from the tool head. As soon as the workpiece guide has reached a position during its delivery movement in relation to the tool head where contact between the electric switch and the dead-zone stop is removed, the electrohydraulic valve is switched to a setting where the hydraulic drive of the holding device pushes it back into its starting position. With the mechanically coupled moving drive member, clamps for the workpiece provided on the holding device are controlled.

Because of the sequence including the several switching functions described, activation of the holding devices is relatively slow on the known machine tools. Since contact between the electric switch on the workpiece guide assembly and the dead-zone stop assigned to it stays the same, regardless of the movement of the holding devices, so long as the switch is in contact with the dead-zone stop, the holding device will travel a path which is always of the same length into its spaced position determined by the structural design of the piston-cylinder unit of the moving drive after the workpiece is released.

Accordingly, on the known machine tools, the holding devices move around the tool head in a relatively large area, and it takes a relatively long time before the holding devices can be engaged with the workpiece again after it has been moved from the tool head. Because of the circumstances mentioned, the disadvantage is that the processing times that can be achieved with the known machine tools are not short.

The object of the invention is therefore to create a machine tool which allows accelerated processing of the workpiece compared to the known machine tools.

SUMMARY OF THE INVENTION

This object is solved by the present invention in which, on a machine tool of the type specified at the beginning, a switching element is connected to a holding device and has a switching slide which is acted on by force and supported in a position running up to the stop in the direction of the stop. The switching slide in at least one slide position connects an energy source to the drive for the particular holding device and breaks this connection in at least one other slide position. On a machine tool of this type, the drive by means of which the holding device is moved relative to the workpiece, is switched directly by the switching element. There are no other switching functions requiring additional switching time.

Moreover, the switching of the switching element is coupled directly with the relative movement of the holding device opposite the workpiece. If the switching element with the switching slide runs roughly up to the stop which defines the danger area around the tool head, the switching slide is moved over into a switch position in which the drive moves the holding device away from the tool head. As soon as the holding device moves into a position outside the danger area around the tool head, the slide moved with the holding device takes a position in which the holding device is stopped. After the tool head passes by, the slide of the switching element, with a stop used as a dead-zone stop with a corresponding design, is moved in the opposite direction from its previous movement and finally takes a position in which the holding device is moved back to the workpiece into its starting position.

Accordingly, the holding devices on the known machine tools are moved away from the workpiece by only the distance necessary to go around the tool head safely. The holding devices on the machine tools of the present invention go around the tool head directly adjacent the boundary of its danger zone and can therefore be reattached to the workpiece within the shortest time after the tool head is passed. All in all, therefore, higher tooling speeds can be achieved on the machine tool of the present invention.

Basically, the advantages of the machine tool of the present invention that were described above can also be achieved in cases where the holding devices are moved relative to the workpiece and the workpiece guide assembly by means of electric drive devices. In one preferred form of embodiment of the machine tool, the holding devices can be moved relative to the workpiece and the workpiece guide assembly by means of a moving drive with at least one drive piston/cylinder unit as the drive. In this case, the advantageous effects described above can be achieved by having the drive piston/cylinder unit connected to a drive pressure source by the switching element, where the switching element is a directional control valve with a valve slide as the switching slide, which in at least one slide position opens the connection between the drive pressure source and the drive piston/cylinder unit and closes it in at least one other slide position.

In one advantageous embodiment of the present invention, the drive cylinder is connected to the holding device, the drive piston is designed as a double-acting piston and is connected to the workpiece guide assembly by a piston rod, the annulus of the drive cylinder is permanently connected to the drive pressure source and the cylinder interior can be connected to the drive pressure source or to an unpressurized space on the side of the drive piston facing away from the annulus by the directional control valve. In at least one slide position, the valve slide opens the connection between the drive pressure source and the cylinder interior on the side of the drive piston spaced from the annulus; in another slide position, it closes this connection and releases the connection between the cylinder interior on the side of the drive piston spaced from the annulus and the unpressurized side. In a slide position in which the valve slide opens the connection between the drive pressure source and the cylinder interior on the side of the drive piston spaced from the annulus, the holding device is at the workpiece in its starting position. Now, if the valve slide moves to the stop marking the danger zone around the tool head, the valve slide will be moved in a sliding position in which it closes the connection between the drive pressure source and the cylinder interior on the side of the drive piston space from the annulus and opens the connection between this cylinder space and the unpressurized space. When the drive cylinder with the holding device connected to it by means of the drive pressure permanently prevailing in the annulus of the drive cylinder is moved relative to the drive piston, here the drive piston releases the pressure medium prevailing in the cylinder interior on the side of the drive piston away from the annulus into the unpressurized space, and the holding device finally takes its position away from the tool head. After the holding device is moved away from the tool head and the valve slide is released from the stop, the valve slide goes back into its starting position. Now, the cylinder interior on the side of the drive piston facing away from the annulus is reconnected to the drive pressure source. Accordingly, pressure builds in this cylinder interior and the drive cylinder is moved back to its starting position in which the holding device is in its starting position engaging the workpiece.

The moving drives described above can all be designed both as a pneumatic and as a hydraulic drive system.

The last form of embodiment is found in one preferred design of the machine tool of the present invention in which a hydraulic directional control valve is provided as a switching element. The hydraulic moving drive can be switched directly by means of the hydraulic directional control valve.

Another advantageous embodiment of the invention provides that the valve slide be acted on by force by means of a spring element acting in the direction of the stop. A spring element offers a structurally simple, easy to maintain way of having a biasing force act on the valve slide. In addition to or alternately to this action by a spring element, the valve slide can be acted on by a force applied by a drive pressure source acting in the direction of the stop.

Besides the drive of the holding devices relative to the workpiece and the workpiece guide assembly, the control of the attachment of the holding devices to the workpiece or release of the holding devices from the workpiece offers a way of increasing the speed of processing the workpiece. The faster the holding device is moved with the workpiece guide assembly in the direction of the tool head can be released before the workpiece reaches the tool head; and the faster the released holding device can be reattached to the workpiece after it is away from the tool head, the faster the workpiece can be delivered to the tool head without affecting the safety of its attachment to the workpiece guide assembly.

One preferred form of embodiment of the machine tool in the present invention provides that the holding devices be attached to the workpiece and controlled by means of the switching element assigned to them. This avoids the mechanical sluggishness associated with direct mechanical coupling of the movement of the holding devices relative to the workpiece and the workpiece guide assembly and the attachment or release of the holding devices. A corresponding design of the switching element allows the functions "Move Holding Devices" and "Attach and Release Holding Devices" to be simultaneous or at least to be executed one after the other in a rapid time sequence.

Another form of embodiment of the machine tool of the present invention in which the holding devices or clamps have at least two jaws between which the workpiece is held clamped and in which at least one jaw is mounted so it can turn about a rotational axis and wherein a directional control valve with a valve slide is provided as a switching element, is characterized by the fact that the rotary mounted jaw on the side of the rotational axis away from the workpiece projects over it and is supported on a control inclined surface rising in the direction opposite the workpiece. The clamp is connected to a control piston which enters a control cylinder and can be moved to it along a path parallel to the plane of the workpiece and the control cylinder can be connected to a actuating pressure source by the directional control valve. The valve slide of the directional control valve, in at least one control position, opens the connection between the control cylinder and the actuating pressure source and in at least one other control position closes the connection. On such a machine tool, the same switching element can be used to control the holding device in the position releasing the workpiece or in the position attaching the workpiece and for actuating the drive to move the holding device relative to the workpiece and the workpiece guide assembly. By using control piston/cylinder units that can be acted on separately by an actuating pressure, the holding devices can be attached to the workpiece or detached from it while uncoupled from their relative movement in relation to the workpiece and the workpiece guide assembly. A corresponding arrangement of the control edges on the valve slide of the directional control valve makes sure that the functions "Release Workpiece," "Move Holding Device Away From Workpiece," "Move Holding Device Toward Workpiece" and "Attach Holding Device" can run one after another in a closely timed sequence.

One advantageous embodiment of a machine tool of the present invention provides for the control piston to be designed as a differential piston and for the interior of the control cylinder bordered by the smaller piston surface to be connected permanently to the actuating pressure source, and the interior in the control cylinder bordered by the larger piston surface can be connected to the actuating pressure source or to an unpressurized space by the directional control valve. The valve slide in one control position opens the connection between the actuating pressure source and the control cylinder interior bordered by the larger piston surface and in at least one other control position closes this connection and releases the connection with the unpressurized interior.

To simplify the design, the drive pressure source is provided as an actuating pressure source in another preferred form of embodiment of the machine tool.

If the rotary mounted jaws are supported by a supporting roller on the control curved surface, the friction occurring on the contact surface between the control inclined surface and the jaw is reduced, and this produces a smooth mechanical swinging drive for the jaws.

So that the workpiece to be processed on the machine tool embodying the present invention can be attached to the workpiece guide assembly before the start of the processing cycle as simply as possible to save as much time as possible, one convenient embodiment provides that the valve slide can be moved into a position opening the connection between the control cylinder and the actuating pressure source and/or in a position closing this connection by means of a bridging actuating pressure. The bridging actuating pressure allows the holding devices to be controlled independently of contact between the switching element and the stationary stop opposite the tool head in which position they release the workpiece. In this position of the holding devices, the workpiece to be processed can be inserted into the holding devices to prepare for the processing cycle. Conveniently, the valve slides of all switching elements can be acted on at the same time by the bridging actuating pressure so that the workpiece being processed can be inserted into all holding devices or clamps at the same time. This minimizing the assembly time for the machine tool minimize the total processing time for the workpiece.

Another preferred embodiment of the present invention provides for control of the holding devices independently of contact between the valve slides and the stationary stop opposite the tool head. The valve slide has two telescoping partial slides which move toward one another in the direction of movement, and they can be moved against one another against a resetting force. The first partial slide on the stationary stop opposite the tool head and the second partial slide is moved into a position opening the connection between the control cylinder and the actuating pressure source and/or into a position closing this connection by means of the bridging actuating pressure acted on relative to the first partial slide.

BRIEF DESCRIPTION OF THE DRAWINGS

The invention will be explained in greater detail using schematic drawings of one embodiment.

DETAILED DESCRIPTION OF THE ILLUSTRATED EMBODIMENT

Figure 1:
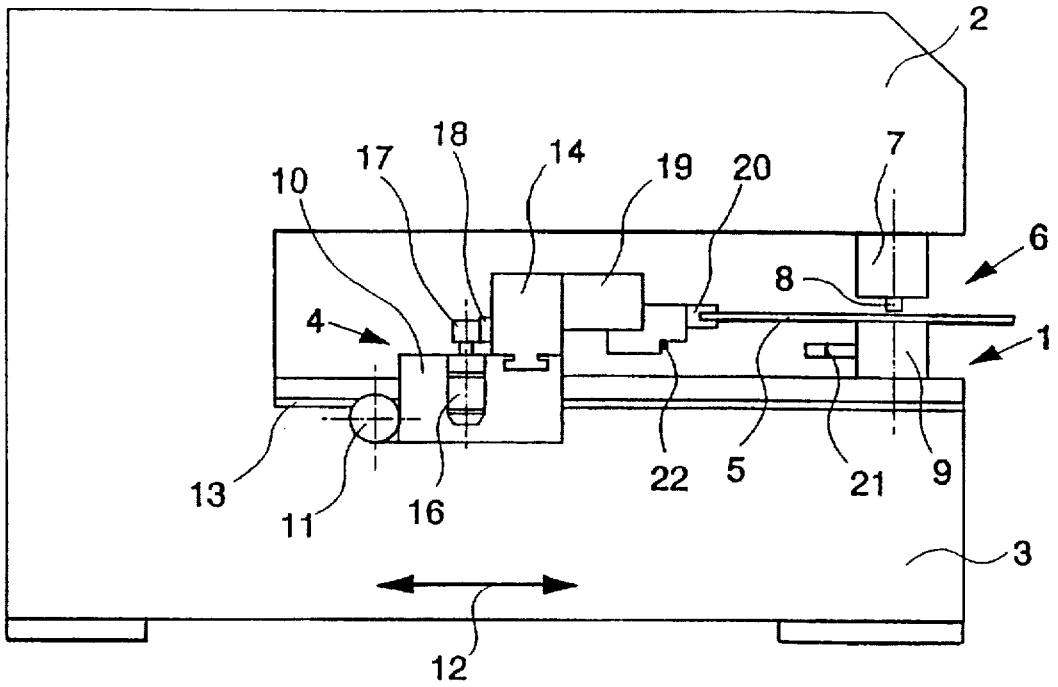
FIG. 1 is a side elevational view of a punch press with a workpiece guide assembly embodying the present invention.
Figure 2:
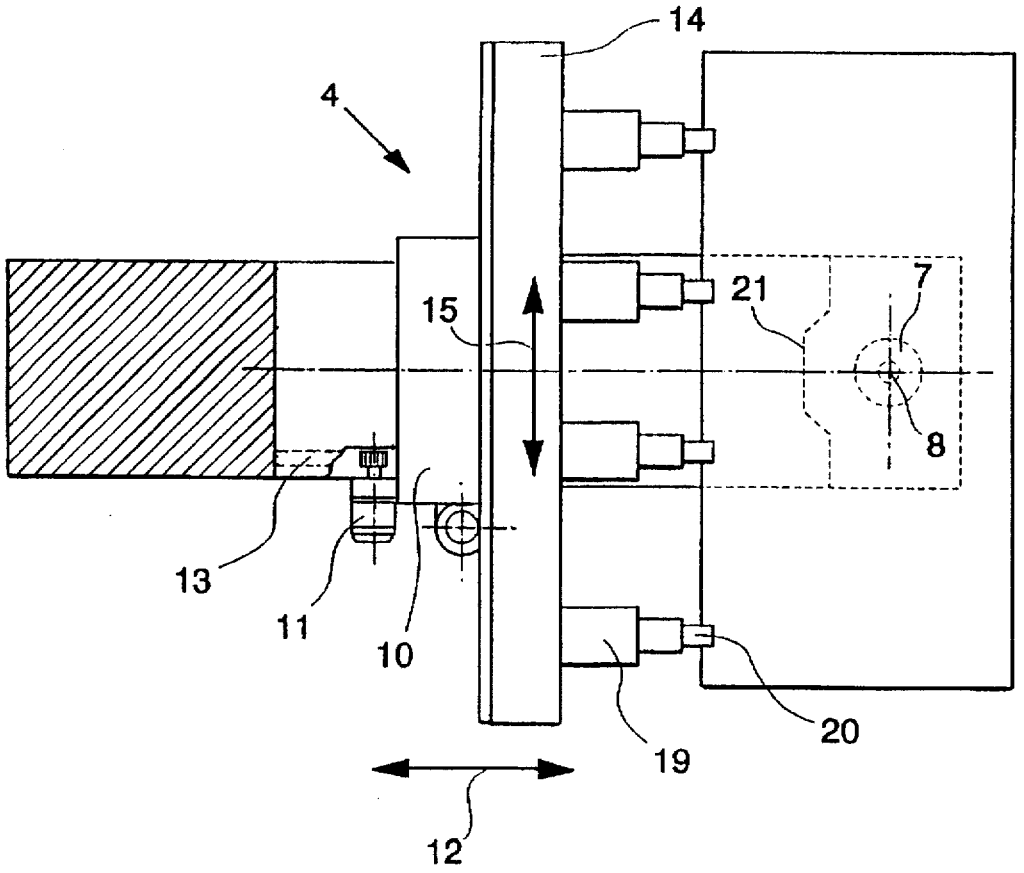
FIG. 2 is a sectional view along the line 2—2 of FIG. 1.

As can be seen in FIGS. 1 and 2, the punch press includes a frame 1 with a cantilevered head 2 and a machine base 3. In the throat between the head 2 and the base 3 of the machine tool, a workpiece guide assembly 4 will move a workpiece 5 in the form of a metal sheet in a horizontal plane relative to the punch work station 6 adjacent the front end of the frame 1.

The punch work station 6 has a processing head or ram 7 mounted in the head 2 of the press and it carries a punch 8 which is moved upwardly and downwardly, and a die holder 9 in the base 3 of the press in which a die (not shown) is supported. The workpiece guide assembly 4 includes a guide carriage 10 which can be moved in the direction of the double arrow 12 and is driven by means of a motor 11. For this purpose, a pinion 60 mounted on the drive shaft 61 of the motor 11 meshes with a toothed rack 13 on the base 3 of the press. A cross rail 14 can move on the guide carriage 10 transversely of its direction of movement and in the direction of a double arrow 15. The cross rail 14 is driven by a motor 16 and a drive pinion gear 17 which acts on a toothed rack 8 firmly connected to the cross rail 14.

On the side facing the punch work station 6, six guide housings 19 are rigidly connected to the cross rail 14. Inside the guide housing 19 is a holding device in the form of a clamp 20 which can move relative to the guide housing 19 in the direction of the double arrow 12. In FIG. 2, only four of the more usual six guide housings 19 and clamps 20 are shown. A stop designated as a dead-zone stop 21 is connected firmly to the die holder 9 and defines a danger zone around the tool head 7. One switching element 22 is placed on each of the clamps 20 and moves with the clamp 20 to cooperate the dead-zone stop 21.

As can be seen from FIG. 2, continuous processing of the edges of the sheet metal workpiece 5 is possible only if the individual holding devices 20 are temporarily removed from the workpiece 5. Only then is the area otherwise covered by a holding device 20 accessible for punching by the punch 8 on the tool head 7.

Figure 3:
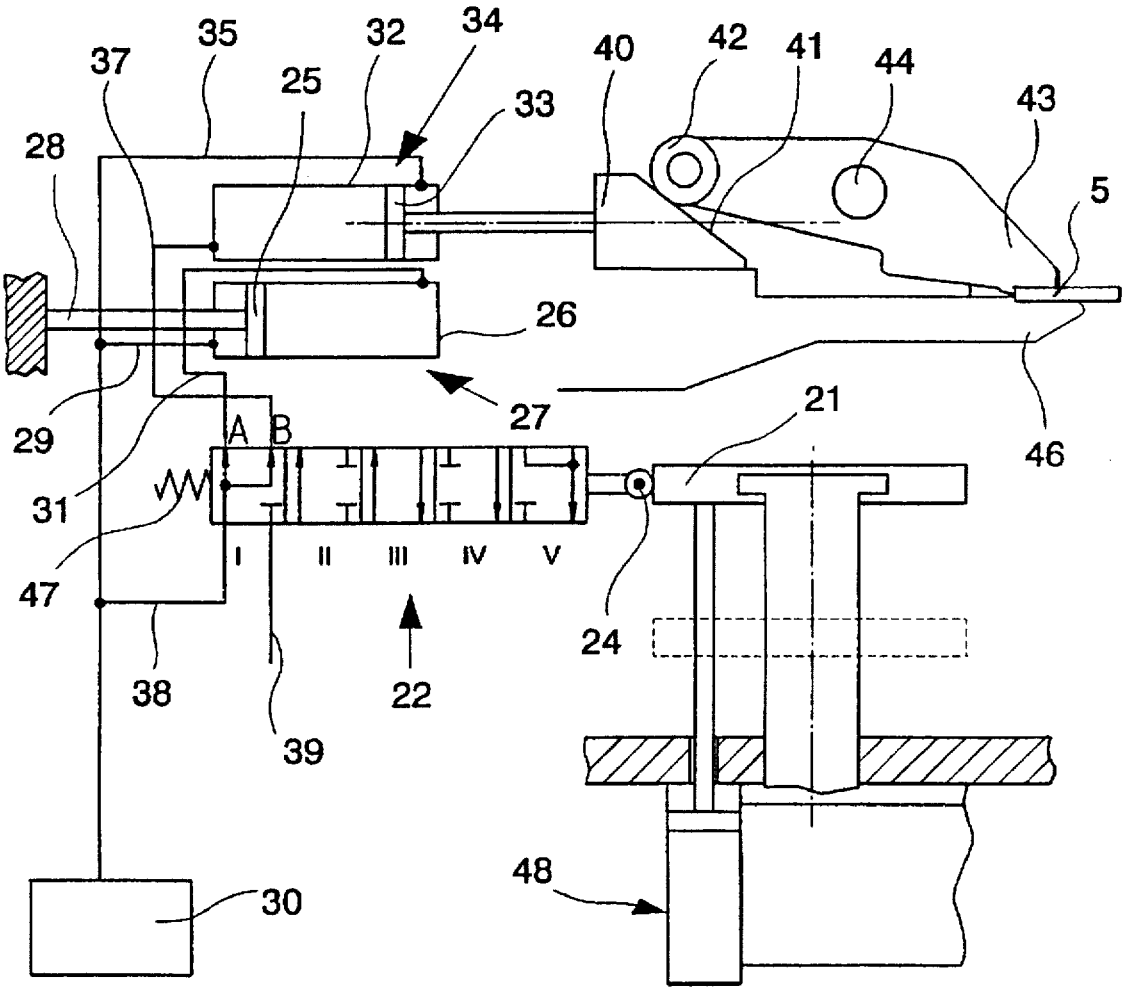
FIG. 3 is a fragmentary diagrammatic side view of the workpiece guide assembly and a holding device of the punch press of FIGS. 1 and 2 with a schematically illustrated hydraulic switch assembly.

If the workpiece 5 is moved by the cross rail 14 as seen in FIG. 2, the switching element 22 of the lower clamp 20 adjacent to the tool head 7 abuts the dead-zone stop 21. As a result, this clamp 20 is opened and moves relative to the workpiece 5 and the accompanying guide housing 19 in the direction of the cross rail 14 by action of the piston 33 as seen in FIG. 3. This pulled back or remote position of the clamp 20 is maintained until the switching element 22 no longer abuts the dead-zone stop 21. During this time, the workpiece 5 is engaged with the workpiece guide assembly 4 by other clamps 20. As soon as the cross rail 14 has moved the lower clamp 20 in FIG. 2 away from the tool head 7 of the punch press to a distance preset by the dead-zone stop 21, contact between the switching element 22 and the dead-zone stop 21 ends, and the clamp 20 is moved back into its starting position on the workpiece 5 and is engaged with it.

Figure 4:
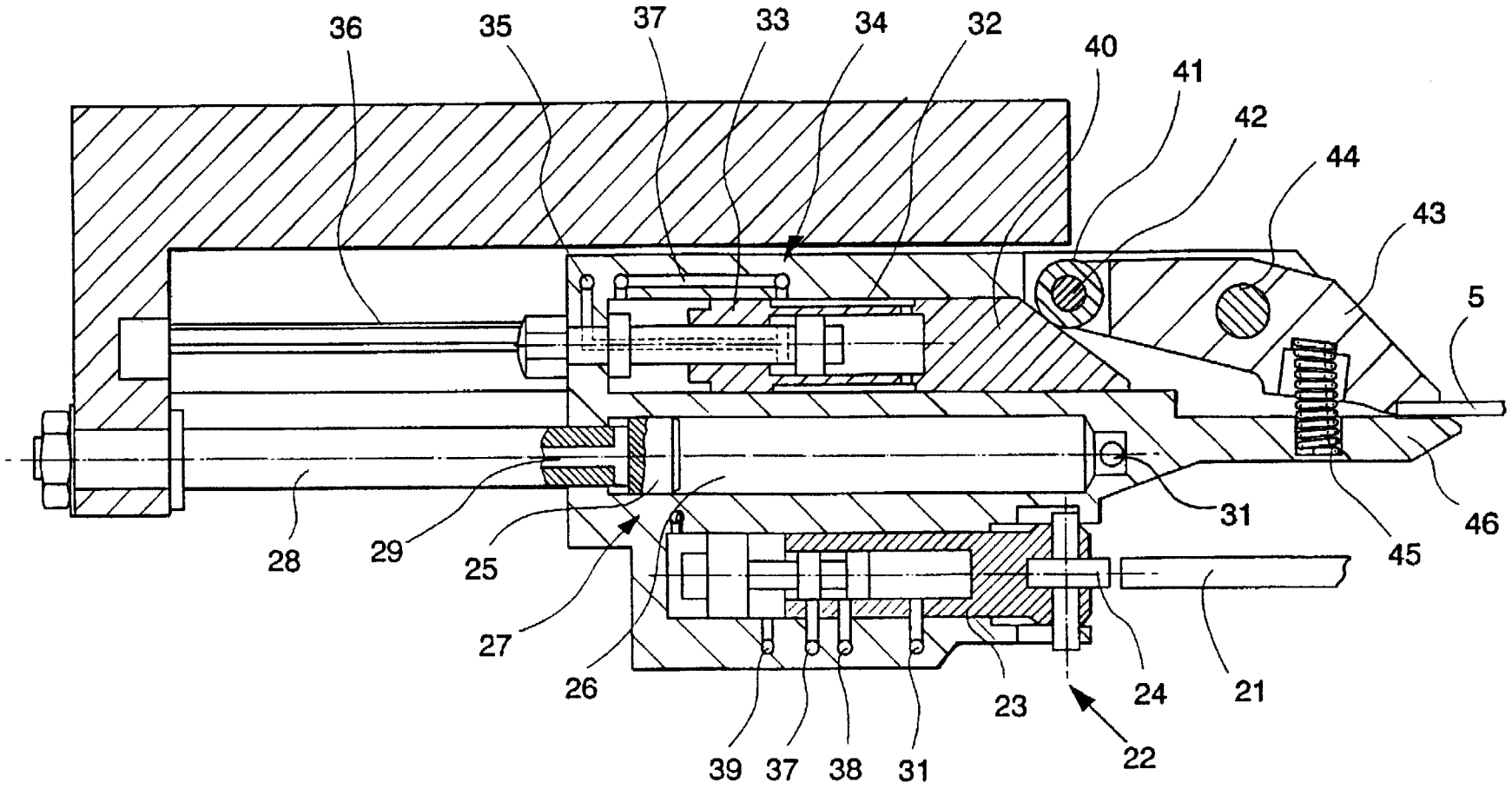
FIG. 4 shows a sectional drawing of a workpiece holding device of the punch press showing its switching element.

The operative components which make the functional sequence described above possible, and their interaction, are shown in detail in FIG. 3 in principle and especially in FIG. 4.

A hydraulic directional control valve with a valve slide 23 is used as the switching element; it supports a roller 24 which will contact the dead area stop 21 when its clamp 20 moves close to the tool head 7. The valve slide 23 can take five slide positions I, II, III, IV and V.

To move the clamp 20 relative to the workpiece 5 and the guide housing 19 and thus relative to the workpiece guide assembly 4, there is a drive piston cylinder unit 27 consisting of a drive piston 25 and a drive cylinder 26. The drive piston 25 is designed as a double acting differential piston and is attached by the piston rod 28 to the guide housing 19. The drive cylinder 26 is connected to the clamp 20.

The annulus of the drive cylinder 26 is connected to a hydraulic pump 30 used as a pressure source for the drive by a passage 29 in its center, and it is acted on by hydraulic fluid which is under pressure. The cylinder space of the drive cylinder 26 on the side of the drive piston 25 away from the annulus is connected to a working connection of the directional control valve 22 by a hydraulic line.

A master cylinder 32 and a piston valve 33 form the actuating piston valve master cylinder unit 34. The piston valve 33 is also designed as a double acting differential piston. The master cylinder space bounded by the smaller piston surface is permanently connected to the hydraulic pump 30, which is also used as a pressure source, by a pressure line 35 which runs partially as a central longitudinal passage inside a guide rod connected to the guide housing 19. A hydraulic line 37 connects the master cylinder space bounded by the larger surface of the piston valve 33 to the second working connection of the directional control valve 22.

Lastly, the directional control valve 22 is connected to the hydraulic pump 30 by a pump line 38 and by a tank line 39 to a hydraulic tank (not shown) which is at ambient pressure.

Designed as a unitary component with the piston valve 33 is a clamping piston 40, which has a rising control surface 41 sloped in the direction of the piston valve 33 provided on its wedge-shaped end facing away from the piston valve 33. A clamping jaw of the clamp 20 is supported on the control slope 41 by a supporting roller 42. The clamping jaw 43 is mounted so it can pivot about a rotary axis and it is acted on by a pressure spring in the form of coiled spring 45 on the side away from the supporting roller 42. A rigid clamping jaw 46 on the clamp 20 is used as a support for the workpiece 5 and as an abutment for the coiled spring 45.

In the starting position shown in FIGS. 3 and 4, the clamp 20 is clamped to the workpiece 5. The valve slide 23 is in slide position I, in which it connects the hydraulic pump 30 by the pump line 38 and the hydraulic lines 31, 37 to the chamber of the drive cylinder 26 on the side of the drive piston 25 not facing the annulus and to the space of the master cylinder 32 bounded by the larger surface of the piston valve 33. The tank line 39 is closed. The pressure is the same on both sides of the drive piston 25, namely the drive pressure produced by the hydraulic pump 30. Because of the different size of the piston and cylinder surfaces acted on by the drive pressure, the drive cylinder 26 is moved into its end position to the right in FIGS. 3 and 4. The same is true for the clamp 20 connected to the drive cylinder 26. Because of the corresponding pressure surface ratios on the piston valve master cylinder unit 34, the clamping piston 40 designed in one piece with the piston valve 33 also takes its end position to the right in FIGS. 3 and 4. In this position, the clamping piston 40 acts on the clamping jaws 43 by the control slope 41 in the closing direction.

Now, if the valve slide 23 with the roller 24 arranged on its front end is moved during the movement of the workpiece 5 brought about by the workpiece guide assembly 4 relative to the dead-zone stop 21, it is first moved into the slide position II. In slide position II, as before, the chamber of the drive cylinder 26 on the side of the drive piston 25 not facing the annulus is connected to the hydraulic pump 30. The connection between the hydraulic pump 30 and the master cylinder space bounded by the larger surface of the piston valve 33 that can be produced by the pump line 38 is closed in slide position II.

Continued movement of the directional control valve 22 toward the dead-zone stop 21 leads to movement of the valve slide 23 into its slide position III. In slide position III, the valve slide 23 connects the master cylinder space bounded by the larger surface of the piston valve 33 by the hydraulic line 37 and the tank line 39 to the unpressurized hydraulic tank. In this position of the directional control valve 22, the piston valve 33, by the action of the hydraulic pressure prevailing in the annulus of the master cylinder 32, pushes the hydraulic fluid out of the master cylinder space bounded by the larger surface of the piston valve 33. Concurrently with this, there is a movement of the clamping piston 40 in FIGS. 3 and 4 to the left. Acted on by the coiled spring 45, the clamping jaw 43 can now pivot into its opening position in which it releases the workpiece 5.

If the workpiece guide assembly 4 is moved further toward the dead-zone stop 21, the valve slide 23 goes into slide position IV. In slide position IV, the connection that can be produced by the pump line 38 between the hydraulic pump 30, and the space of the drive cylinder 26 on the side of the drive piston 25 turned away from the annulus is closed. Thus, the clamp 20 is moved by the machine control into the opening position as before.

If the valve slide 23 continues to move toward the dead-zone stop 21, finally the space of the drive cylinder 26 on the side of the drive piston 25 spaced from the annulus is connected to the unpressurized tank line 39 by the valve slide 23. In this position V of the directional control valve 22, the drive piston 25, by the action of the drive pressure prevailing on the annulus produced by the hydraulic pump 30, can push the hydraulic fluid to the opposite side. Accordingly, the drive cylinder 26, along with the clamp 20 connected to it, is moved to the left as seen in FIGS. 3 and 4. The already opened clamp 20 is then moved away from the workpiece 5 and pulled back opposite the tool head 7 at the punch work station 6. This pull back or retracting movement ends as soon as the valve slide 23 moved with the clamp 20 is far enough from the dead-zone stop 21 so that it is returned from the slide position V into slide position IV by the force of a diagrammatically illustrated spring 47.

The dead-zone stop 21 is located adjacent the tool head 7 so that the clamp 20 is always kept outside the danger zone around the tool head 7. In addition, the dead-zone stop 21 is designed so that contact with the valve slide 23 ends as soon as the clamp 20 has moved away from the tool head 7 to a predetermined safe distance. As soon as the clamp 20 has reached this position, the valve slide 23 is released and it then returns first to slide positions III and II, in which the open clamp 20 on the workpiece 5 is restored before it resumes slide position I, in which the clamp 20 is closed and attached to the workpiece 5.

A reciprocating piston cylinder unit 48 shown in FIG. 3 is used for lifting and lowering the dead-zone stop 21. Lowering the dead-zone stop 21 is made possible, for example, in cases where the tool in the punch work station can be changed using the tool guide assembly 4 and the workpiece guide assembly 4 must be moved near the tool head 7 or the die holder 9 for this purpose. The dead-zone stop 21 is shown in the lowered position in dashed line in FIG. 3.

So that the workpiece guide assembly 4 can be loaded with the workpiece 5 to be processed before the beginning of the processing cycle and so that the workpiece 5 can be taken out of the workpiece guide assembly 4 after the end of the processing, the clamps 20 can be switched into the open position. This is possible independently of the contact between the valve slide 23 and the dead-zone stop 21 by means of the devices shown in FIGS. 5 and 6.

Figure 5:
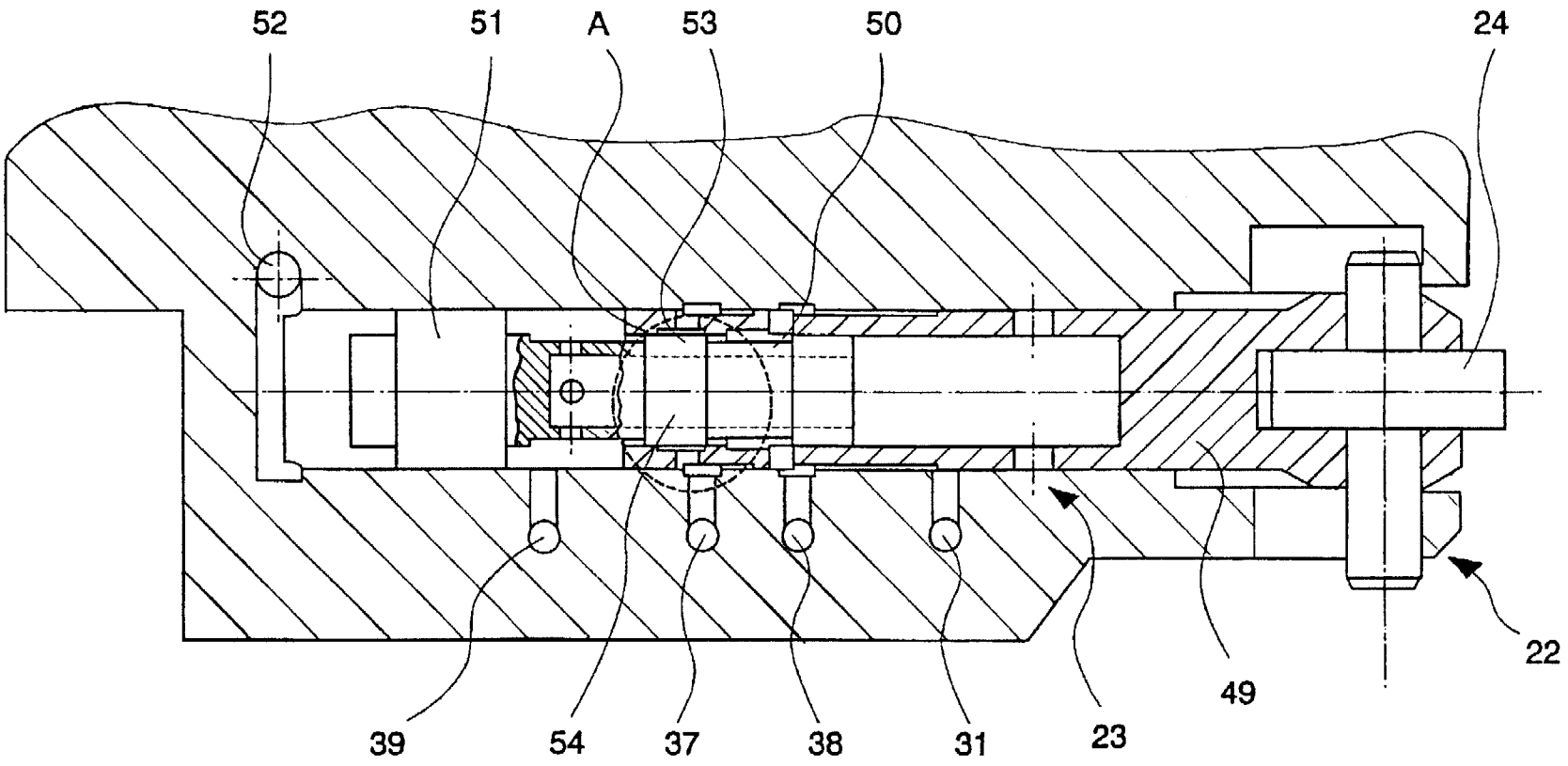
FIG. 5 shows an enlarged fragmentary sectional view of the switching element of FIG. 4.

As shown in FIG. 5, the valve slide 23 is composed of two partial slides 49, 50 which interfit like a telescope in the slide direction. Partial slide 49 cooperates with the dead-zone stop 21 and is moved against it when starting. The switching functions described above are then used.

The partial slide 50 which goes into partial slide 49 can be acted on by a pressure line 52 with a pneumatic bridging actuating pressure on the piston 51. Control edges 53, 54 of the inner partial slide 50 are assigned to control edges on the outer partial slide 49.

Figure 6A:
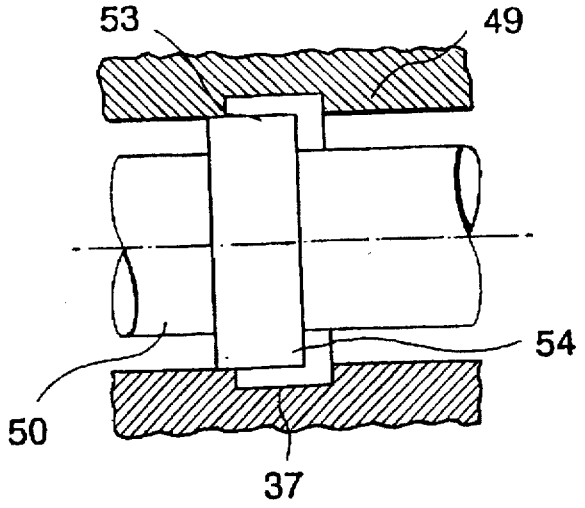
FIGS. 6*a* to 6*c* are schematic views of a portion of the switch of FIG. 5 in various switch positions.
Figure 6B:
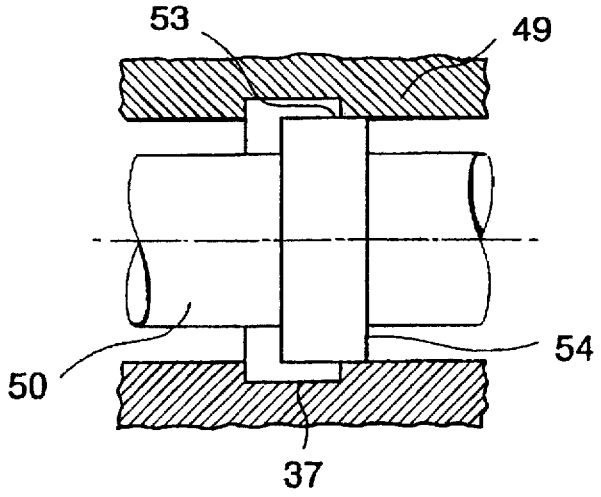

FIG. 6*a* shows the opposite arrangement of the control edges 53, 54 on the inner partial slide 50 opposite the associated control edges on the outer partial slide 49 in the starting position of the switching element 22 In this starting position, the switching element 22 takes the switching position I according to FIG. 3, i.e., the associated clamp 20 is pushed into its end position away from the transverse rail 14 and is moved by the control 62 into the closed position. Now if the clamp 20 is opened in order to allow a workpiece being processed to be inserted into it, the inner partial slide 50 on the piston 51 is acted on by pneumatic bridging actuating pressure. As a result, the inner partial slide 50 moves relative to the outer partial slide 49 which is supported on the housing of the control valve 22, as can be seen in FIG. 5, until the control edges 53, 54 take the position shown in FIG. 6*b*. In this position, the control edges 53, 54 close the hydraulic line 37 against the pump line 38 and at the same time release the connection between the hydraulic line 37 and the tank line 39. Accordingly, the piston valve 33, by the action of the pressure prevailing constantly in the chamber of the master cylinder 32 bounded by its smaller surface, can be moved to the left in FIG. 3. As described above, this makes the clamping piston 40 move in the same direction and then the clamping jaw 43, which is pivotably mounted, pivots into the open position. Now, the workpiece 5 being processed can be placed on the rigid clamping jaw 46 of the clamp 20.

As a result of the release of the piston 51 from the pneumatic bridging actuating pressure which was acting on it, the inner partial slide 50 moves back into its starting position in which the control edges 53, 54 take the position shown in FIG. 6*a*. Now, the pump line 38 is reconnected to the hydraulic line 37, and the hydraulic pump acts on the chamber of the master cylinder 33 bounded by the larger side of the piston valve 33. As a result of this, the piston valve 33 is pushed back into the starting position shown in FIG. 3 in which the pivoting clamping jaw 43, activated by the clamping piston 40, acts on the workpiece 5 to be processed.

Figure 6C:
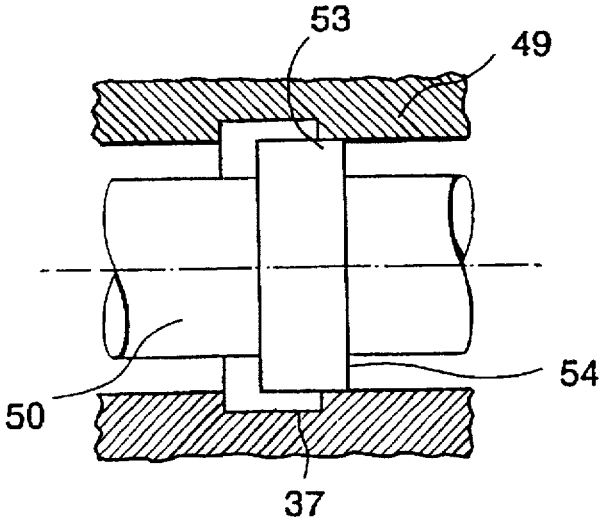

For the sake of completeness, in FIG. 6*c* the position of the control edges 53, 54 of the inner partial slide 50 is shown in the operating state of the directional control valve 22 in which the inner partial slide 50 is not loaded and the outer partial slide 49 that moves to the dead-zone stop 21 is pushed into its position closing the hydraulic line 37 leading to the master cylinder 32.

A computer or numeric control 62 effects operation of the various motors and drives the various switches and valves.

Thus, it can be seen from the attached drawings and foregoing detailed description that the machine tool of the present invention enables processing of the workpiece over substantially its entire surface.

Having thus described the invention, what is claimed is:

1. A machine tool comprising:

(a) a tool head for processing a workpiece;

(b) a workpiece guide assembly movable relative to said head;

(c) at least two holding devices on said guide assembly which are engageable with the workpiece, said holding devices being movable relative to said workpiece and relative to the workpiece guide assembly;

(d) drive devices each coupled to a respective one of said holding devices for effecting movement thereof relative to said tool head and said guide assembly;

(e) energy conduit means connected to each of said drive devices for connection to an energy source to effect operation of said drive devices to move said holding devices;

(f) each of said holding devices carrying a switching element for movement therewith; and (g) a stationary stop positioned adjacent said tool head and cooperating with said switching elements, each of said switching elements having a switching slide which is supported on its associated holding device in a position wherein said switching slide is movable when said switching element abuts said stop, each of said switching slides in one position connecting the energy source to its associated drive device and in another position breaking said connection, each of said holding devices being movable into a position releasing the workpiece when its associated switching element abuts said stop and being movable relative to the workpiece and said tool head into a position at a safe distance from said tool head.

2. A machine tool according to claim 1 wherein at least one of said drive devices includes a piston valve master cylinder unit connectable by its associated switching element to a drive pressure source providing the associated energy source, said switching element of said at least one drive device comprising a directional control valve with a valve slide movable in said control valve and which, in one slide position, opens the connection between the drive pressure source and said piston valve master cylinder unit, and in another slide position, closes said connection.

3. A machine tool according to claim 2 wherein said piston valve master cylinder unit includes a master cylinder providing a chamber and a piston valve movable in said chamber to provide a space on each side of said piston valve, said piston valve being connected to its associated drive device, wherein said piston valve is a double acting piston connected to said workpiece guide assembly by a piston rod, wherein said master cylinder is permanently connected to the drive pressure source, wherein the cylinder space on the side of said piston valve spaced from said connection to said drive pressure source is connectable by said directional control valve to the drive pressure source or to atmospheric pressure, and wherein said valve slide in at least one slide position opens the connection between the drive pressure source and said cylinder space on said spaced side of said piston valve and in another slide position closes said connection between the drive pressure source and said spaced cylinder space and releases the connection between said spaced cylinder space and atmospheric pressure.

4. A machine tool according to claim 2 wherein there is included a biasing spring biasing said valve slide in the direction of said stop.

5. A machine tool according to claim 2 wherein said valve slide is movable in the direction of said stop by the drive pressure source.

6. A machine tool according to claim 2 wherein said drive pressure source is an actuating pressure source.

7. A machine tool according to claim 1 wherein each of said switching elements is a hydraulic directional control valve and said energy source is a hydraulic pump.

8. A machine tool according to claim 1 wherein each of said holding devices has at least two clamping jaws having ends adjacent said stop and between which the workpiece is clamped, at least one of said jaws being pivotably mounted for pivoting about a horizontal axis intermediate its length to open and close the space between said ends of said jaws, wherein each of said switching element is a directional control valve with a valve slide, each of said pivotable clamping jaws having its end spaced from said stop movable along an inclined control surface rising from said horizontal axis, each of said control surfaces being provided on a piston valve reciprocatable in a master cylinder and movable parallel to the plane of the workpiece, each of said master cylinders being connectable to the energy source by its respective directional control valve, said energy source being an actuating pressure source, each of said directional control valves in one position opening the connection between its associated master cylinder and said actuating pressure source and in at least one other control position closing said connection.

9. A machine tool according to claim 8 wherein each of said master cylinders provides a chamber and its associated piston valve is a differential piston with smaller and larger piston surfaces movable in said chamber to provide a space therein adjacent each of said piston surfaces, the space in said master cylinder bounded by said smaller piston surface being permanently connectable to the actuating pressure source, wherein the space in said master cylinder bounded by the larger piston surface is connectable by said directional control valve to the actuating pressure source or to atmospheric pressure, and wherein a respective valve slide in one control position opens the connection between the actuating pressure source and said master cylinder space bounded by said larger piston surface and in at least one other control position closes said connection between the actuating pressure source and said master cylinder space and releases the connection with atmospheric pressure.

10. A machine tool according to claim 8 wherein said movable end of each of said pivotable clamping jaws has a roller thereon seated on its respective control surface.

11. A machine tool according to claim 8 wherein each of said valve slides is actuatable by an actuating pressure and movable into a position opening the connection between its respective master cylinder and the actuating pressure source and into a position closing said connection.

12. A machine tool according to claim 11 wherein each of said valve slides has two partial slides which telescope in the direction of its movement and which are movable towards one another against a resetting force, wherein one of said partial slides is operatively engageable with said stationary stop adjacent said tool head and the other partial slide is acted on by the actuating pressure and is movable relative to said one partial slide into a control position releasing the connection between its associated master cylinder and the actuating pressure source and a control position closing said connection.

13. A machine tool comprising:

(a) a tool head for processing a workpiece;

(b) a workpiece guide assembly movable relative to said head;

(c) at least two holding devices on said guide assembly which are engageable with the workpiece, said holding devices being movable relative to the workpiece and relative to said workpiece guide assembly;

(d) drive devices each coupled to a respective one of said holding devices for effecting movement thereof relative to said tool head and said guide assembly;

(e) energy conduit means connected to each of said drive devices for connection to a drive pressure source to effect operation of said drive devices to move said holding devices;

(f) each of said holding devices carrying a switching element for movement therewith;

(g) a stationary stop positioned adjacent said tool head and cooperating with said switching elements, each of said switching elements having a switching slide which is supported on its associated holding device in a position wherein said switching slide is movable when said switching element abuts said stop, each of said switching slides in one position connecting the energy source to its associated drive device and in another position breaking said connection, each of said holding devices being movable into a position releasing the workpiece when its associated switching element abuts said stop and being movable relative to the workpiece and said tool head into a position at a safe distance from said tool head, at least one of said drive devices including a piston valve master cylinder unit connectable by its associated switching element to the drive pressure source, said switching element of said at least one drive device comprising a directional control valve with a valve slide movable in said control valve and which, in one slide position, releases the connection between the drive pressure source and said piston valve master cylinder unit and in another slide position closes said connection.

14. A machine tool according to claim 13 wherein said piston valve master cylinder unit includes a master cylinder providing a chamber and a piston valve movable in said chamber to provide a space on each side of said piston valve, said piston valve being connected to its associated drive device, wherein said piston valve is a double acting piston connected to said workpiece guide assembly by a piston rod, wherein said master cylinder is permanently connected to the drive pressure source, wherein the cylinder space on the side of said piston valve spaced from said connection to said drive pressure source is connectable by said directional control valve to the drive pressure source or to atmospheric pressure, and wherein said valve slide in at least one slide position opens the connection between the drive pressure source and said cylinder space on said spaced side of said piston valve and in another slide position closes said connection between the drive pressure source and said spaced cylinder space and releases the connection between said spaced cylinder space and atmospheric pressure.

15. A machine tool according to claim 13 wherein each of said holding devices has at least two clamping jaws having ends between which the workpiece is clamped, at least one of said jaws being pivotably mounted for pivoting about a horizontal axis intermediate its length to open and close the space between said ends, wherein each of said switching elements is a directional control valve with a valve slide, each of said pivotable clamping jaws having its end spaced from said stop movable along an inclined control surface rising from said horizontal axis, each of said control surfaces being provided on a piston valve reciprocatable in a master cylinder and movable parallel to the plane of the workpiece, each of said master cylinders being connectable to the drive pressure source by its respective directional control valve, said valve slide of each of said directional control valves in one position opening the connection between said master cylinder and said drive pressure source and in another control position closing said connection.

16. A machine tool according to claim 15 wherein each of said master cylinders provides a chamber and wherein its associated piston valve is a differential piston with smaller and longer piston surfaces movable in said chamber to provide a space therein adjacent each of said piston surfaces, the space in said master cylinder bounded by said smaller piston surface being permanently connectable by said directional control valve to the drive pressure source, wherein the space in said master cylinder bounded by the larger piston surface is connectable by said directional control valve to the drive pressure source or to atmospheric pressure, and wherein a respective valve slide in one control position opens the connection between the drive pressure source and said master cylinder space bounded by said larger piston surface and in another control position closes said connection between the drive pressure source and said master cylinder space and releases the connection with atmospheric pressure.

17. A machine tool according to claim 16 wherein said movable end of each of said pivotable clamping jaws has a roller thereon seated on its respective control surface.

18. A machine tool according to claim 13 wherein each of said switching elements is a hydraulic directional control valve and the pressure source is a hydraulic pump, and wherein there is included a biasing spring biasing said valve slide in the direction of said stop.

19. A machine tool according to claim 13 wherein said valve slide is movable in the direction of said stop by the drive pressure source.

* * * * *